US007028766B2

(12) United States Patent
Ren

(10) Patent No.: US 7,028,766 B2
(45) Date of Patent: Apr. 18, 2006

(54) HEAT EXCHANGER TUBING WITH CONNECTING MEMBER AND FINS AND METHODS OF HEAT EXCHANGE

(75) Inventor: Baolute Ren, Lancaster, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/721,139

(22) Filed: Nov. 25, 2003

(65) Prior Publication Data

US 2005/0109496 A1 May 26, 2005

(51) Int. Cl.
*F28D 1/04* (2006.01)

(52) U.S. Cl. ..... 165/171; 165/183

(58) Field of Classification Search ..... 165/171, 165/151, 148, 183
See application file for complete search history.

(56) References Cited

U.S. PATENT DOCUMENTS 2,991,047 A * 7/1961 Bailys ..... 165/153
3,012,758 A * 12/1961 Lyon, Jr. ..... 165/153
3,046,758 A * 7/1962 Heuer et al. ..... 165/170
3,810,509 A * 5/1974 Kun ..... 165/148
4,235,281 A * 11/1980 Fitch et al. ..... 165/171
4,285,397 A * 8/1981 Ostbo ..... 165/171
5,501,270 A * 3/1996 Young et al. ..... 165/151
5,513,432 A * 5/1996 Sasaki et al. ..... 165/171
2004/0173344 A1* 9/2004 Averous et al. ..... 165/173
2004/0177948 A1* 9/2004 Cho et al. ..... 165/183
2004/0256093 A1* 12/2004 Romero Beltran ..... 165/171

* cited by examiner

*Primary Examiner*—Teresa J. Walberg
(74) *Attorney, Agent, or Firm*—Daniels P. Cillo

(57) ABSTRACT

A heat exchanger tubing includes at least a pair of tubes (1) that are connected to and separated by a connecting member (3). The connecting member (3) has a number of fin projections (7) extending at an angle from the member (3), each fin projection (7) having an opening (9) to allow air to pass through the member. The tubing is arranged between headers (21) of a heat exchanger (20) in an angled configuration so that the fins align with the air flow (A) passing across the tubing for enhanced heat exchange. The connecting member (3) can also be multivoid tubing (41), which has the fin projections for heat transfer or uses the passageways (49) in the multivoid tubing and fluid flowing through the channels for heat exchange.

10 Claims, 2 Drawing Sheets

HEAT EXCHANGER TUBING WITH CONNECTING MEMBER AND FINS AND METHODS OF HEAT EXCHANGE

FIELD OF THE INVENTION

The present invention is directed to heat exchanger tubing for heat exchanger construction, and particularly to a tubing configuration having a fin-containing connecting member as an integral part of the tubing.

BACKGROUND ART

In the prior art, heat exchanger design typically employs a series of tubing, and fins mounted to the tubes. The tubes act as conduits for fluid flow whereby heat from an operating device such as an air conditioner is brought to the heat exchanger. The fins that are mounted to the tubes facilitate the transfer of heat from the tubes to the surrounding media, which in most instances is the ambient environment.

While heat exchangers are used in a vast array of applications, one popular use is in the automotive field, wherein condensers as heat exchangers are used in conjunction with automotive air conditioning. These types of heat exchangers are made using essentially two different designs. A first design uses round tubing and bare fins that are mechanically attached to the round tubes by first lacing the tubes into holes punched in the fins, and then expanding the tubes to ensure that the tubes' outer surfaces are in close contact with the fins.

A second design uses a flat tubing having a plurality of channels in the tubing, commonly referred to as multivoid tubing. This type normally includes a number of parallel flow channels or passageways that are separated by webs or walls that run along the longitudinal axis of the tubing. Fluid to be cooled runs through the channels or passageways. In making these types of heat exchangers, the tubes are joined to corrugated fins using a brazing process.

In comparing the two types of tubing construction, it is more economical to manufacture tubing using the mechanical attachment technique with round tubes and fins, and these types of assemblies are popular for automotive and residential condenser use where cost considerations are important. However, the heat transfer efficiency is poor for these tubing assemblies as compared to those utilizing a brazed connection between the tubes and the fins. Thus, each type of tubing is not without its own drawback, either higher manufacturing cost or less than adequate heat transfer efficiency.

Therefore, a need exists for improved heat exchanger tubing that has high heat transfer efficiency and can be easily manufactured. The present invention solves this need by providing a heat exchanger tubing configuration that still uses fins for heat exchange, but does so without requiring either the expensive brazing step or the presence of a mechanical attachment between tubing and fins that compromises heat transfer efficiency.

SUMMARY OF THE INVENTION

It is a first object of the invention to provide an improved heat exchanger tubing configuration.

Another object of the invention is a heat exchanger including headers and a number of the inventive tubing configurations disposed between the headers.

A still further object of the invention is to provide a tubing configuration that offers high efficiency in terms of heat exchange while at the same time being economical to manufacture.

Yet another object of the invention is a heat exchanger using multivoid tubing disposed between tubes and with fins and openings to permit the use air or without openings to permit the use of cooling fluid disposed within the multivoid tubing for heat exchange.

One other object of the invention is methods of heat exchange using the inventive tubing configurations, using a gas as a medium flowing over the tubing configuration, a second heat exchange fluid, or a combination of both.

Other objects and advantages of the invention will become apparent as the description thereof proceeds.

In satisfaction of the foregoing objects and advantages, the present invention is an improvement in heat exchanger tubing and heat exchangers that use tubing and fluids for heat exchange purposes. The invention is also an improvement in the prior art types of heat exchanger tubing that relied on mechanically attached or brazed fin construction. In one embodiment, the inventive tubing configuration comprises at least two tubes, each tube having at least one channel therein for the passage of a heat exchange fluid. A connecting member is arranged between and connected to the two tubes. The connecting member includes a plurality of spaced apart fins, each extending at an angle from a surface of the connecting member, and a plurality of spaced apart openings extending through the connecting member. Each spaced apart opening is associated with one of the respective spaced apart fins, such that the fin acts as a heat exchange surface and helps direct air through the opening.

The connecting member can have a solid construction, or be made of multivoid tubing. The fins can be punched or formed from the connecting member so that the fin shape matches the shape of the opening in the member. Openings and fins can have any number of spacings from adjacent openings and fins, both longitudinally and laterally, can vary in size, and can vary in number, both laterally and longitudinally.

The invention also entails a heat exchanger with the tubing configurations disposed between headers and allowing flow of heat exchange fluid between headers via the tubing configuration. When using connecting members with fins and openings, air or other gas flow is the primary mode for extracting heat from the fluid passing through the tubing configuration. When using multivoid tubing without the openings/fins, a second heat exchange fluid can pass through the multivoid tubing for heat exchange purposes.

Preferably, the tubing configuration is made from an aluminum alloy, and one that can be extruded so that the connecting member and tubes can be made as one piece.

The tubes can be divided into multiple channels by webs, and can have surfaces, whether on the tube inner circumferential wall or webs, that are smooth, non-smooth, or a combination of both.

Also disclosed is a method of heat exchange using tubes and headers wherein cooling fluid passes through the tubes for heat exchange. In one mode, the heat exchange fluid is passed through the tubes of the tubing configuration, and the tubing configuration is mounted between the headers so that the fins are generally aligned with a direction of gas, e.g., air, flow to enhance heat transfer. In another mode when using multivoid tubing, the tubing is used without fins and openings, and another heat exchange fluid passes through the passageways of the multivoid tubing for heat exchange.

BRIEF DESCRIPTION OF THE DRAWINGS

Reference is now made to the drawings of the invention wherein.

DESCRIPTION OF THE PREFERRED EMBODIMENTS

The present invention offers significant advantages over prior art tubing assemblies or arrangements that are presently used for heat exchanger applications. That is, the tubing configuration of the invention combines the heat transfer efficiency found in heat exchangers having brazed construction with the economies of manufacture found in those employing mechanical assembly techniques. In one embodiment, the inventive tubing configuration also has the capability to use a second cooling or heat exchange fluid for heat exchange.

The inventive tubing configuration provides the fin-type heat exchange that is found in prior art heat exchanger assemblies, but without the need for brazed construction and without the loss of heat exchanger efficiency. In one mode, this dual benefit is accomplished via the use of a connecting member with fin projections and openings for air flow through the plate. The entire configuration can be made as a one piece construction, with the fin projections and openings being easily formed using conventional forming techniques. Further, the tubing configuration can be easily adapted to fit the needs of a particular application by adjusting any one or more of a number of variables, e.g., the spacing between fin projections, the size of the openings adjacent the fin projections, the width of the connecting member, the type of connecting member, and the like. More fin projections/openings can be employed if needed for more heat exchange. Further, the angle of the fin projections can be altered, as can be the angling of the tubing with respect to the heat exchanger headers to accommodate the restraints or requirements imposed by the heat exchanger location. The cross sectional shape of the connecting member could also be curved or other non-linear shape.

Figure 1:
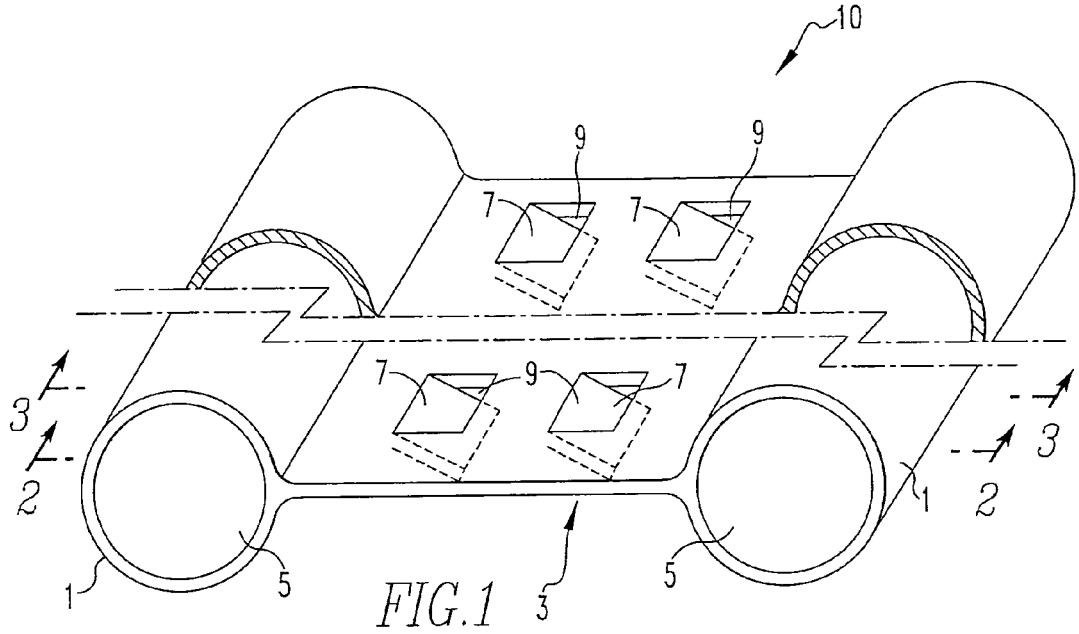
FIG. 1 is a perspective view of one embodiment of the inventive tubing configuration.
Figure 2:
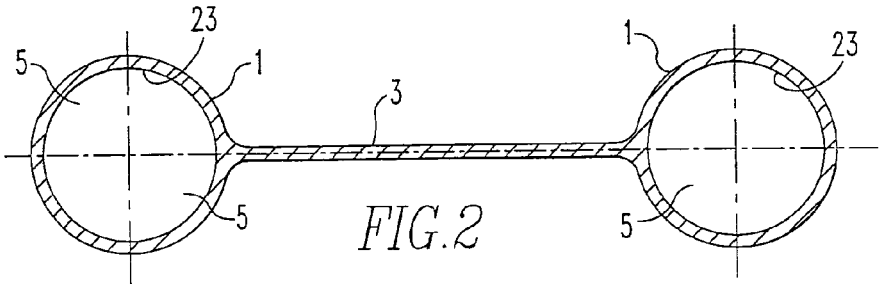
FIG. 2 is a cross sectional view along the line 2—2 of FIG. 1.
Figure 3:
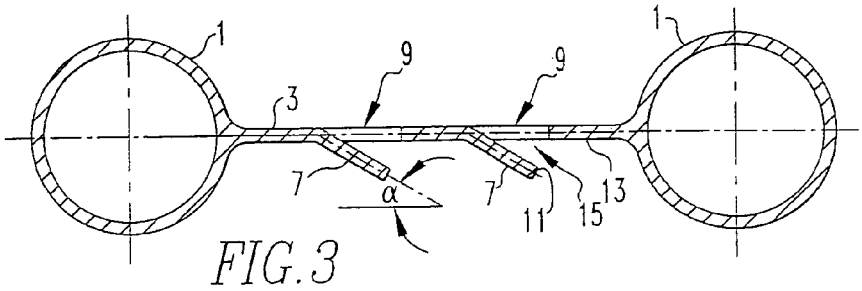
FIG. 3 is a cross sectional view along the line 3—3 of FIG. 1.

Referring now to FIGS. 1–3, one example of the inventive tubing configuration is designated as reference numeral 10, whereby the tubing configuration includes a pair of tubes 1, each interconnected by a connecting member shown as a plate 3. Each tube has a channel 5 therein, the channel providing a passageway for the flow of a cooling fluid through the tube 1 for heat exchange purposes.

The connecting plate 3 extends between the tubes 1 both laterally and longitudinally and includes a number of fin projections 7. Each fin projection 7 has an opening 9 associated with it, the opening 9 extending through the plate 3. The opening 9 forms a passageway for air to flow past the plate 3 for heat exchange. As will be described below, when the tubing arrangement 10 is installed between headers, the fin projections and openings are configured with respect to the headers to improve heat transfer.

The configuration 10 can be made using any dimensions typical of heat exchanger applications, including various diameters for the tubes 1, various widths of the connecting member between the tubes 1, different thicknesses for the tubing walls and plate, and various overall lengths.

While the fin projections 7 and openings 9 are spaced apart and aligned both longitudinally and laterally in FIG. 1, other spacing arrangements can be employed without departing from the invention. For example, the fin projections 7 and openings 9 could be spaced apart longitudinally and aligned on a bias rather than aligned laterally as shown in FIG. 1. Alternatively, more than two fin projections/openings could be positioned between the tubes 1, either laterally as shown in FIG. 1, or on a bias, a combination thereof. If desired, the openings 9 and fin projections 7 could be located randomly on the connecting member 3. As another option, openings could have other shapes than the generally square ones shown in FIG. 1, e.g. circular or oval, rectangular, trapezoid (corrugated, louvered) or the like. In yet another mode, a single line of fin projections and openings could be used along the longitudinal dimension of the tubing arrangement.

The fin projections 7 and openings 9 can be formed in any known ways. One preferred way is through a punching operation wherein the fin projection itself is punched from the plate so that the projection and opening are formed simultaneously, and their shapes generally match. The punching operation would also control the extent of the fin projection from the connecting member to form the angle $\alpha$ as shown in FIG. 3. Each end 11 of each fin projection 7 and the plate edge 13 forms an entrance to allow air or other gaseous medium that may be used for heat exchange purposes to pass over the fin projection 7 and through the opening 9 for heat exchange. The angle $\alpha$ can vary depending on the application. It is preferred to have the fin projections range between about 5–90 degress and more preferably between about 20–40 degrees and most preferably between 25 and 35 degrees.

The formation of the connecting member and tube combination (prior to the fin projection formation step) is preferably done using an extrusion process and the use of an aluminum alloy typically used in these types of applications. By using extrusion, the tubes 1 and plate 3 can be formed in a one-piece design, and there is no need to make a connection between the tubes 1 and plate 3. The extrusion process may include the necessary heat treatments as well to obtain the desired properties in the final extruded product. Of course, other techniques whereby the tubes 1 and plate 3 would be made separately, and the tubes 1 and plate 3 are then connected, e.g., extrusion of the tube and plate separately followed by brazing, or other attachment procedures.

Figure 4:
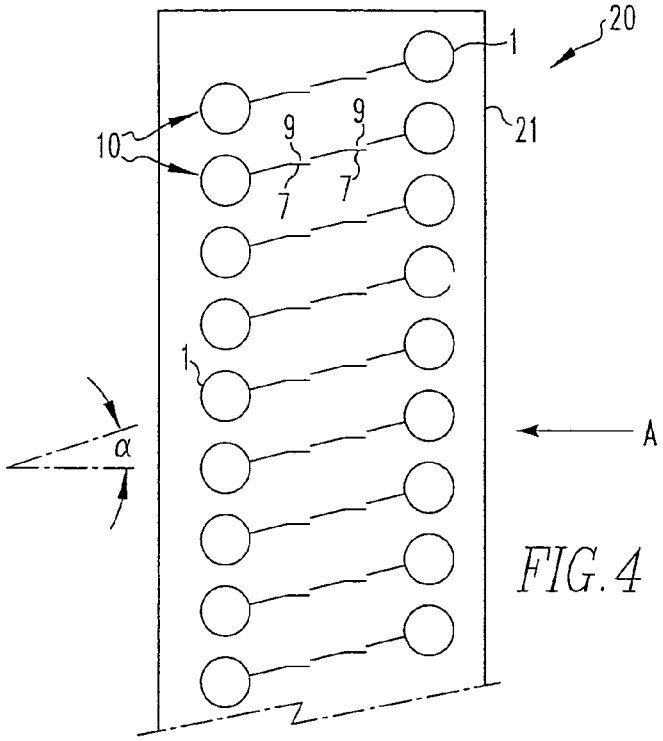
FIG. 4 is a schematic view of a number of the tubing configurations of FIG. 1 in a heat exchanger.

FIG. 4 shows a partial schematic view of a heat exchanger 20 with a number of the tubing configurations 10 shown in FIG. 1. In FIG. 4, the tubing configurations 10 are stacked vertically, with one end (not shown) connected to a header 21. The other header that would complete the circuit of coolant flow back and forth through the tubes 1 and header 21 of FIG. 4 is not shown for clarity purposes. The remaining components of the heat exchanger such as the inlet and outlet connections to the header and header details are also omitted since these components are conventional and not necessary for understanding of the invention. The manner of interfacing between the tubes and the headers is also considered conventional and a further description thereof is not necessary for understanding of the invention. Similarly, the tubing configurations could be stacked in other orientations, e.g., horizontally, diagonally, etc., if the heat exchanger application required such alignment.

Important to the efficiency of the heat exchanger is the orientation of the tubing configuration 10 with respect to the direction of air flow across the heat exchanger. The direction of air flow is represented by arrow A in FIG. 4. As is evident from this figure, the tubing configuration 10 is mounted between the headers at an angle with respect to the air flow direction A, which in most instances is generally horizontal. The angle of incline β for the tubing with respect to direction A should generally match the angle α of the fins 7 as shown in FIG. 3. In this way, the fin projections will lie in a plane that is generally aligned with the anticipated direction of air flow. With this orientation, the entranceway 15 between the fin ends 11 and plate edge 13 is oriented generally perpendicular to direction A to maximize the air flow through the openings 9 in the plate 3. In addition, a spring (not shown) may be added into a tube 31 to enhance the heat exchange. Those skilled in the art will recognize that when adding such a spring, it is preferable that the interior surface of tube 31 is smooth.

Figure 5:
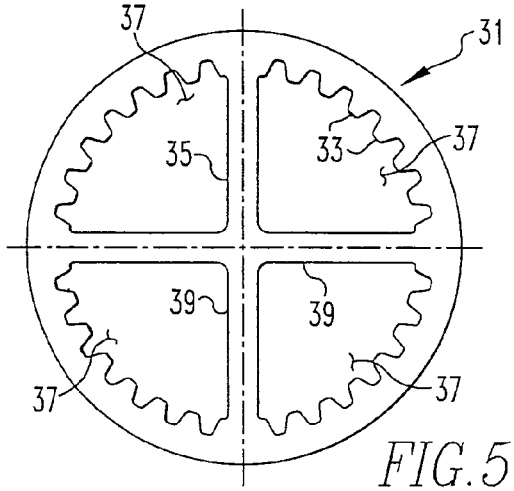
FIG. 5 shows an enlarged cross sectional view of an alternative tube design.

While the tubes 1 are shown with a smooth inner surface 23, see FIG. 2, the inner surface can have a non-smooth surface, i.e., ridges, projections or other irregularities, to enhance the heat transfer effect. This embodiment is best seen in FIG. 5, which shows an exemplary tube 31 with projections 33 running along an inner tube surface. The tube 31 also is shown with an additional web structure 35 in the tube channel 37. The illustrated web structure 35 divides the tube channel 37 into four quadrants, and provides additional surface area for heat transfer. The web structure 35 can be most easily made using an extrusion process so that the web structure and tubing wall are of one piece in construction. Although not shown, the web structure 35 could also have one or more surfaces that are not smooth, e.g., projections similar to projections 33 along one or more of the surfaces 39 thereof if so desired. While the web structure forms equal quadrants, other structures could be employed. For example, the tube 31 could be divided into halves, thirds, sixths or the like, or divided unequally if so desired.

Those skilled in the art will recognize that for the embodiment of FIG. 5, the remaining components of the heat exchanger such as the inlet and outlet connections to the header and header details may need to be specially designed for the specific number of divisions of tube 31. Such special designs not necessary for understanding of the invention.

In another embodiment, and while two tubes 1 are shown, three or more tubes could be employed. With three tubes, two connecting members can be employed with one of the tubes disposed between two connecting members, and the other two tubes at the ends of the members. As with the two tube embodiment, the fin projections and openings could vary in placement, angle, and shape.

Figure 6:
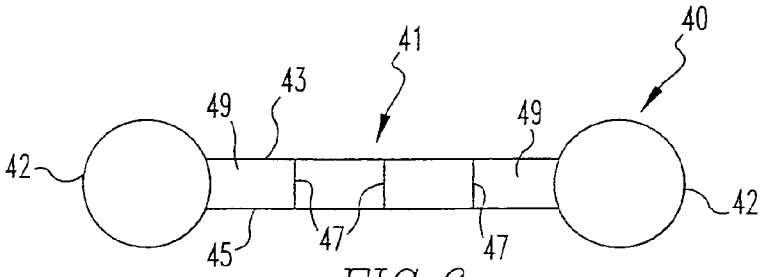
FIG. 6 is a sectional view of an alternative tubing configuration.

Another embodiment of the invention is shown schematically in FIG. 6, wherein the tubing configuration 40 is shown with a multivoid tubing plate 41 disposed between tubes 42 as the connecting member. The multivoid tubing plate is similar to that found in present day heat exchangers wherein the tubing has opposing walls 43 and 45, and number of webs 47 disposed between the walls. The webs create passageways 49 through which cooling fluid can pass for heat exchange purposes.

When using the plate 41, another cooling fluid could be used for primary heat exchange or in combination with a gas. For example, one type of a fluid would pass through tubes 42 with another type of fluid passing through passageways 49 of the tubing plate 41. Alternatively, the same fluid could be used in both the tubes and the passageways of the multivoid tubing. The fluids could be selected so that the fluid passing through passageways 49 cools the fluid passing through tubes 42, or vice versa. In this arrangement, the headers would be specially configured to allow passage of the two heat exchange fluids through the tubes 42 and tubing plate 41. The tubing plate 41 could have any number of passageways 49 and could vary in size as dictated by the particular heat exchange application. Gas/air or the like could also be passed across the tubing configuration 40 if so desired.

Although not shown, the tubing plate 41 could also be used in the embodiment of FIG. 3, wherein air or another gaseous medium is the primary heat exchange fluid. That is, instead of using a cooling fluid passing through the passageways 49, the tubing plate 41 could be configured with fins and openings similar to the fins 7 and openings 9 of FIG. 3. These openings/fins could be created by the use of dies or the like that would punch out the openings from within the passageways 49 to form an opening through the plate 41 and a fin just as shown in FIG. 3.

It should be understood that the tubing configurations 10 and 40, or any of the variations described above can be used in any type of heat exchanger that would employ headers or other structure that would direct a cooling fluid through the tubing 1 or 42. Preferred heat exchanger applications include automotive condensers and residential air conditioners. Also, the tubing and the heat exchanger could be fabricated of any material, although a preferred material is an aluminum alloy, particularly the types that are commonly used in these types of heat exchanger applications.

The present invention also entails a method of using the inventive tubing configuration for heat exchange purposes whereby a cooling fluid passes through tubes of the tubing configuration. The fins and openings are used in conjunction with a media, air or the like, that flows across the tubing configuration when they are properly angled so that the fin projections align generally with the direction of gas flow. In another mode, heat exchange fluids pass through the tubes of the tubing configuration and the passageways in the multivoid tubing for heat exchange. In this mode, the angling of the tubing configuration is not as critical, since the fins and openings are not employed, and the tubing configuration could take on any orientation with the headers.

As such, an invention has been disclosed in terms of preferred embodiments thereof which fulfill each and every one of the objects of the present invention as set forth above and provides a new and improved heat exchanger tubing configuration, a header employing such a configuration, and a method of heat exchange using the inventive heat exchanger tubing configuration.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A tubing configuration for use in a heat exchanger comprising:

at least two tubes, each tube having at least one channel therein for the passage of a heat exchange fluid; and a connecting member arranged between and connected to the two tubes, the connecting member being substantially parallel to the tubes and further comprising:

a plurality of spaced apart fins, each extending at an angle from a surface of the connecting member; and a plurality of spaced apart openings extending through the connecting member, each spaced apart opening associated with one of the respective spaced apart fins, wherein each of said spaced apart fins are generally aligned such that the anticipated direction of the airflow through the heat exchanger passes through the substantially spaced apart openings.

2. The tubing arrangement of claim 1, wherein a shape of the spaced apart fin matches a shape of the spaced apart opening associated therewith.

3. The tubing arrangement of claim 1, wherein the at least two tubes and the connecting member are extruded as one piece from an aluminum alloy.

4. The tubing arrangement of claim 1, wherein an inner surface of the channel is smooth, non-smooth, or a combination thereof.

5. The tubing arrangement of claim 1, wherein the channel is divided into a number of smaller channels by one or more webs in the channel.

6. The tubing arrangement of claim 5, wherein inner surfaces of the channels are smooth, non-smooth, or a combination thereof, and surfaces of the one or more the webs are smooth, non-smooth, or a combination thereof.

7. The tubing arrangement of clam 1, wherein the plurality of the spaced apart fins and openings extend along the connecting member in a longitudinal direction, a lateral direction or a combination of both directions.

8. The tubing arrangement of claim 1, wherein the fins are formed from the connecting member.

9. In a heat exchanger comprising a pair of headers interconnected by a plurality of tubing, the headers defining a plane generally perpendicular to a flow path of a gas passing over the plurality of tubing for heat exchange, the improvement comprising a plurality of the tubing configurations of claim 1, each tubing configuration interconnected between the headers in a stacked and angled relationship such that the plurality of fins of each connecting member are generally aligned along the gas flow path.

10. In a method of heat exchange wherein a cooling fluid passes through tubes having heat exchange features attached thereto, the improvement comprising: providing the tubing configuration of claim 1 as the tubes of the heat exchanger, wherein the tubing configurations are oriented so that the fin projections are aligned generally in a direction so that gas flow crossing the tubing configurations passes through the openings and substantially parallel to the fins; and passing a heat exchange fluid through channels in the tubes; and whereby, during heat exchanger operation, gas flows across the fin projections and through the openings in the connecting member for heat exchange purposes.

* * * * *